US011078668B2

(12) United States Patent
Sorkin

(10) Patent No.: US 11,078,668 B2
(45) Date of Patent: Aug. 3, 2021

(54) APPARATUS FOR REPAIRING A TENSION MEMBER

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 16/876,005

(22) Filed: May 16, 2020

(65) Prior Publication Data

US 2020/0378122 A1 Dec. 3, 2020

Related U.S. Application Data

(60) Provisional application No. 62/853,602, filed on May 28, 2019, provisional application No. 62/864,885, filed on Jun. 21, 2019.

(51) Int. Cl.
*E04C 5/12* (2006.01)

(52) U.S. Cl.
CPC ..... *E04C 5/125* (2013.01)

(58) Field of Classification Search
CPC . E04C 5/125; E04C 5/122; E04C 5/10; E04G 21/185; E04G 23/02; E04G 21/12
See application file for complete search history.

(56) References Cited

U.S. PATENT DOCUMENTS 4,363,122 A * 12/1982 Black ..... H04J 3/172 370/435
4,363,462 A * 12/1982 Wlodkowski ..... E04C 5/12 24/115 M
4,410,162 A * 10/1983 Wlodkowski ..... E04C 5/12 249/215
5,749,185 A 5/1998 Sorkin
5,755,065 A 5/1998 Sorkin
5,770,286 A 6/1998 Sorkin
6,098,356 A 8/2000 Sorkin
6,151,850 A 11/2000 Sorkin
6,381,912 B1 5/2002 Sorkin
6,631,596 B1 10/2003 Sorkin
(Continued)

FOREIGN PATENT DOCUMENTS

WO 2016126687 A1 8/2016

OTHER PUBLICATIONS

European Search Report issued in EP App. No. 20175354.8 dated Oct. 26, 2020 (9 pages).

*Primary Examiner* — Patrick J Maestri
(74) *Attorney, Agent, or Firm* — Locklar PLLC

(57) ABSTRACT

An assembly for use with a post-tensioning tension member may comprise an anchor body; an anchor encapsulation including rear and front encapsulation extensions; a rear nut coupled to the rear encapsulation extension; a cap coupled to the front encapsulation extension and including a cap extension; a cover extending around a portion of the tension member, the cover being tubular and having proximal and remote end portions; a coupler coupled to both the cap extension and the proximal end portion; and a remote nut coupled to the remote end portion. The assembly may further include a rear seal positioned between the rear encapsulation extension and the tension member; a front seal positioned between the cap extension and the tension member; a proximal seal positioned between the proximal end portion and the tension member; and a remote seal positioned between the remote end portion and the tension member.

30 Claims, 3 Drawing Sheets

(56) References Cited

U.S. PATENT DOCUMENTS

| | | | | |
|---|---|---|---|---|
| 6,817,148 | B1 | 11/2004 | Sorkin | |
| 7,793,473 | B2 | 9/2010 | Sorkin | |
| 7,797,894 | B1 | 9/2010 | Sorkin | |
| 7,823,345 | B1 | 11/2010 | Sorkin | |
| 7,841,061 | B1 | 11/2010 | Sorkin | |
| 7,841,140 | B1 | 11/2010 | Sorkin | |
| 7,950,196 | B1 | 5/2011 | Sorkin | |
| 7,950,197 | B1 | 5/2011 | Sorkin | |
| 7,963,078 | B1 * | 6/2011 | Sorkin | E04C 5/122 52/223.13 |
| 8,015,774 | B1 | 9/2011 | Sorkin | |
| 8,065,845 | B1 | 11/2011 | Sorkin | |
| 9,097,014 | B1 | 8/2015 | Sorkin | |
| 9,896,845 | B2 * | 2/2018 | Sorkin | E04C 5/125 |
| 10,113,313 | B2 | 10/2018 | Sorkin | |
| 10,711,454 | B2 * | 7/2020 | Sorkin | E04C 5/122 |

* cited by examiner

APPARATUS FOR REPAIRING A TENSION MEMBER

CROSS-REFERENCE TO RELATED U.S. APPLICATIONS

This application is a non-provisional application that claims priority from U.S. provisional application 62/853,602, filed May 28, 2019, and provisional application 62/864,885, filed Jun. 21, 2019, each which is hereby incorporated by reference in its entirety.

TECHNICAL FIELD/FIELD OF THE DISCLOSURE

The present disclosure relates generally to an apparatus for use in post-tensioning concrete.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, bridges, pavement, tanks, reservoirs, silos, foundations, sports courts, and other structures.

The concrete may be poured into a concrete form. The concrete form may be a form or mold to give shape to the concrete as the concrete sets or hardens thus forming a concrete member.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a post-tensioning tendon embedded in the concrete is tensioned after the concrete has attained a specified strength. A post-tensioning tendon may include for example and without limitation, anchorages, the tension member, and sheathes or ducts.

A post-tensioning tendon generally includes a tension member and an anchorage at least at each end. The tension member is fixedly coupled to a fixed anchor positioned at one end of the post-tensioning tendon, sometimes referred to as the "fixed-end" or "dead end" anchor, and is stressed at the other anchor, sometimes referred to as the "stressing-end" or "live end" anchor.

The tension member may be constructed of a material that is suitable for post-tensioning, such as, for example, reinforcing steel or composite material in the form of single or multi-strand cable. A post-tensioning tension member is typically provided in a protective sheath. The sheath may be polymeric and may contain a protective fluid, such as grease, in addition to the tension member. The purpose of the sheath and protective fluid, if present, is to inhibit air, water, and other corrosive substances from contacting the tension member.

The tension member is stressed by pulling the tension member through the stressing anchor; when the pulling force is released, the anchors grip the tension member and retain the tension member in tension. In some instances, the anchors grip the tension member using wedges, so that the gripping force increases when the tension on the tension member increases.

SUMMARY

In some embodiments, an assembly for use with a tension member for post-tensioning concrete may include an anchor body, an encapsulation, wherein the encapsulation at least partially encapsulates the anchor body and wherein the encapsulation includes a rear encapsulation extension and a front encapsulation extension, a rear nut mechanically coupled to the rear encapsulation extension, a cap mechanically coupled to the front encapsulation extension, the cap including a cap extension, a cover extending around a portion of the tension member, the cover being tubular and having a proximal end portion and a remote end portion, a coupler mechanically coupled to both the cap extension and the proximal end portion, and a remote nut mechanically coupled to the remote end portion.

The assembly may further include a rear seal positioned between the rear encapsulation extension and the tension member, a front seal positioned between the cap extension and the tension member, a proximal seal positioned between the proximal end portion and the tension member, and a remote seal positioned between the remote end portion and the tension member. The rear, front, proximal, and remote seals may each be a split seal. The rear, front, proximal, and remote seals may each be sized such that tightening the rear nut, coupler and remote nut to a desired degree deforms the rear, front, proximal, and remote seals such that there are substantially no internal voids in the assembly.

In some embodiments, the assembly may further include a rear seal positioned between the rear extension and the tension member and the rear seal may include a head compressed in an axial direction between the rear nut and rear encapsulation extension.

In some embodiments, the assembly may further include a front seal positioned between the cap extension and the tension member, a proximal seal positioned between the proximal end portion and the tension member, and a tubular long seal positioned between the tension member and the cover and the front seal and the proximal seal may each include a head compressed in an axial direction between the cap extension and the tubular long seal.

In some embodiments, the assembly may further include a remote seal positioned between the remote end portion and the tension member and the rear seal may include a head compressed in an axial direction between the remote nut and the remote end portion of the cover.

In some embodiments, the coupler may mechanically couple to the cap extension at a first threaded interface and may mechanically couple to the proximal end portion at a second threaded interface. The second threaded interface may be reversed with respect to the first threaded interface.

The assembly may further include a cap seal disposed in an annular groove formed in the cap, wherein the cap seal engages at least one of the anchor body or the encapsulation.

In some embodiments, a method for providing an intermediate anchor and cover on a tension member for post-tensioning concrete, may comprise the steps of a) positioning components of an intermediate anchor and cover assembly on the tension member at desired locations, the components comprising: an anchor body, an encapsulation, wherein the encapsulation at least partially encapsulates the anchor body and wherein the encapsulation includes a rear encapsulation extension and a front encapsulation extension, a rear nut, a cap, wherein the cap includes a cap extension, a cover, wherein the cover is tubular and has a proximal end portion and a remote end portion, a coupler; and a remote nut; b) mechanically coupling the cap to the front encapsulation extension; c) positioning a rear seal between the rear encapsulation extension and the tension member and mechanically coupling the rear nut to the rear encapsulation extension; d) positioning a front seal between the cap extension and the tension member; e) positioning a tubular long seal at a desired location on the tension member; f) positioning the cover around the tubular long seal; g) positioning a proximal seal between the proximal end portion and the tension member; h) mechanically coupling the coupler to the cap extension and the proximal end portion; and i) positioning a remote seal between the remote end portion and the tension member and mechanically coupling the remote nut to the remote end portion.

In some embodiments, a kit for assembling an intermediate anchor and cover assembly for use with a tension member for post-tensioning concrete may comprise: an anchor body; an encapsulation, the encapsulation at least partially encapsulating the anchor body and including a rear encapsulation extension and a front encapsulation extension; a rear nut adapted to mechanically couple to the rear encapsulation extension; a cap adapted to mechanically couple to the front encapsulation extension, the cap including a cap extension; a cover adapted to extend around a portion of the tension member, the cover being tubular and having a proximal end portion and a remote end portion; a coupler adapted to mechanically couple to both the cap extension and the proximal end portion; and a rear nut adapted to mechanically couple to the remote end portion.

DETAILED DESCRIPTION

Figure 1:
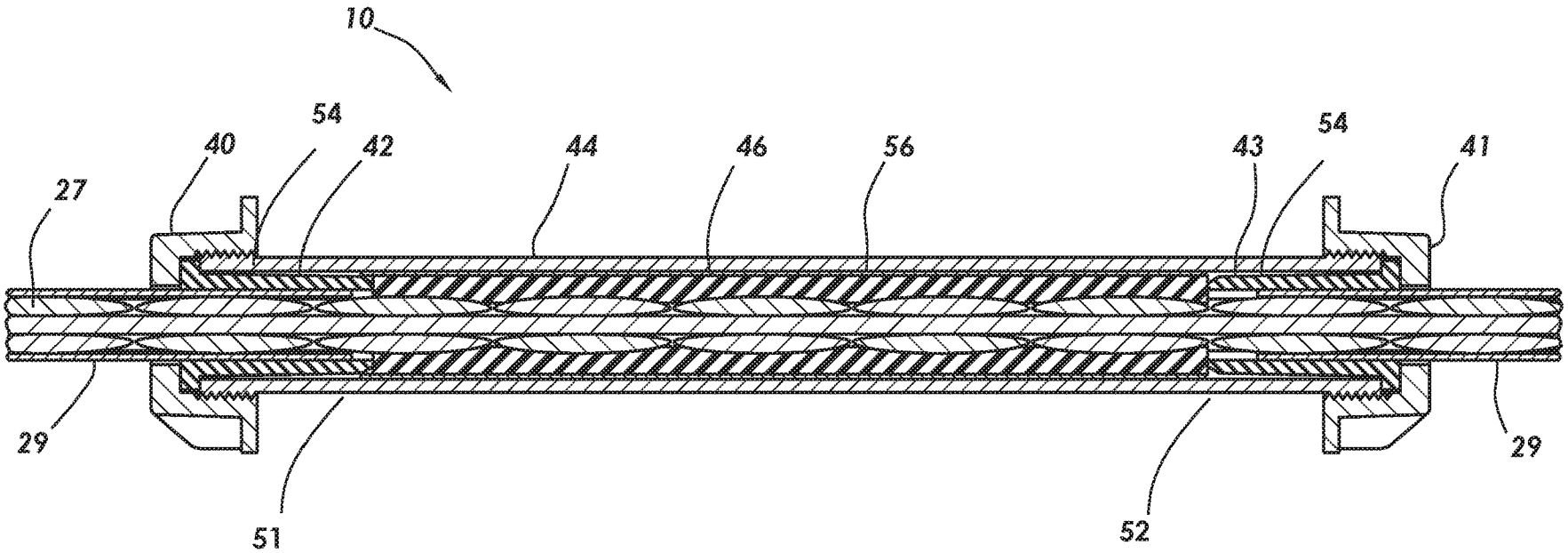
FIG. 1 is a cross-sectional view of a sheathing repair assembly consistent with at least one embodiment of the present disclosure.

Referring to FIG. 1, sheathing repair assembly 10 in accordance with some embodiments may include an outer tube 44 having first end portion 51 and second end portion 52, a tubular long seal 46, first and second seals 42, 43 positioned in first and second end portions 51, 52 of outer tube 44, respectively, and first and second nuts 40, 41 each retaining first and second seals 42, 43 first and second end portions 51, 52 of outer tube 44. Sheathing repair assembly 10 may be used to repair a tension member such as tension member 27 where sheathing 29 is damaged or discontinuous. In one embodiment, sheathing repair assembly 10 includes inner tube 56. In another embodiment, sheathing repair assembly 10 does not include inner tube 56.

The components of the sheathing repair assembly 10 may be fully or partially pre-assembled prior to delivery to the pour site or may be assembled at the pour site.

Outer tube 44 may be made of an elastomeric polymer. Outer tube 44 may be positioned over tension member 27 by sliding outer tube 44 from an end of tension member 27 to a location on tension member 27. In some embodiments, each end portion 51, 52 of outer tube 44 may include engagement feature 54, such as threads, bayonet tabs or a groove or ridge, to facilitate engagement with first and second nuts 40, 41. In some embodiments, outer tube 44 may be provided without engagement feature 54. In some embodiments, the inside diameter of outer tube 44 may be greater than the outside diameter of tubular long seal 46. In some embodiments, the inside diameter of outer tube 44 may be less than the outside diameter of tubular long seal 46. In some embodiments, the inside diameter of outer tube 44 may be substantially the same as the outside diameter of tubular long seal 46.

Tubular long seal 46 may be made of elastomeric polymer and may comprise a compressible elastomer. Tubular long seal 46 may be split longitudinally. Tubular long seal 46 may be applied from the side of tension member 27 by passing the tension member through the slit, so that access to the end of tension member 27 is not required. Tubular long seal 46 may be sized to receive tension member 27 therein. In some embodiments, the inside diameter of tubular long seal 46 may be less than the outside diameter of tension member 27 so that the inner surface of tubular long seal 46 conforms to the outer surface of tension member 27. In some embodiments, the inside diameter of tubular long seal 46 may be substantially the same as the outside diameter of tension member 27.

Optional inner tube 56 may be made of an elastomeric or non-elastomeric polymer, or a metal. In one embodiment, inner tube 56 may have a longitudinal split and may be applied from the side of the tension member. In another embodiment, inner tube 56 may have no split and may be positioned on the tension member by sliding inner tube 56 from the end of the tension member to a desired position. At least one end portion of inner tube 56 may include a hole, tab, or other feature to facilitate movement of inner tube 56. Inner tube 56 may be applied to the outside of tubular long seal 46 after tubular long seal 46 is applied to the tension member 27 and before outer tube 44 is applied to the outside of tubular long seal 46. Inner tube 56 may facilitate the passage of tubular long seal 46 into outer tube 44. Inner tube 56 may protect tubular long seal 46 until outer tube 44 is applied to the outside of tubular long seal 46. The inside diameter of inner tube 56 may be substantially the same as or less than the outside diameter of tubular long seal 46. The outside diameter of inner tube 56 may be substantially the same as the inside diameter of outer tube 44. The outside diameter of inner tube 56 may be less than the inside diameter of outer tube 44.

First and second seals 42, 43 may be made of elastomeric polymer and may be split longitudinally. First and second seals 42, 43 may be applied from the side of tension member 27 by passing tension member 27 through the slit, so that access to the end of tension member 27 is not required.

Each of first and second nuts 40, 41 may mechanically engage outer tube 44 at engagement feature 54, if present, and may include corresponding internal threads, bayonet tabs or a ridge or groove. In some embodiments, first and second nuts 40, 41 may be self-tapping nuts that create threads when threaded onto outer tube 44. In some embodiments, each of first and second nuts 40, 41 is a threaded or self-tapping nut engaged with outer tube 44.

When assembled, sheathing repair assembly 10 defines a longitudinal passage that is adapted to receive tension member 27 and to sealingly engage the outer surface thereof. The presence of sheathing repair assembly 10 on tension member 27 seals the portion of tension member 27 that is within the assembly, i.e. between first and second nuts 40, 41. In each embodiment and each method described herein, repairing a tension member sheath may include re-sheathing to prevent the ingress of fluid into tension member 27.

Figure 2:
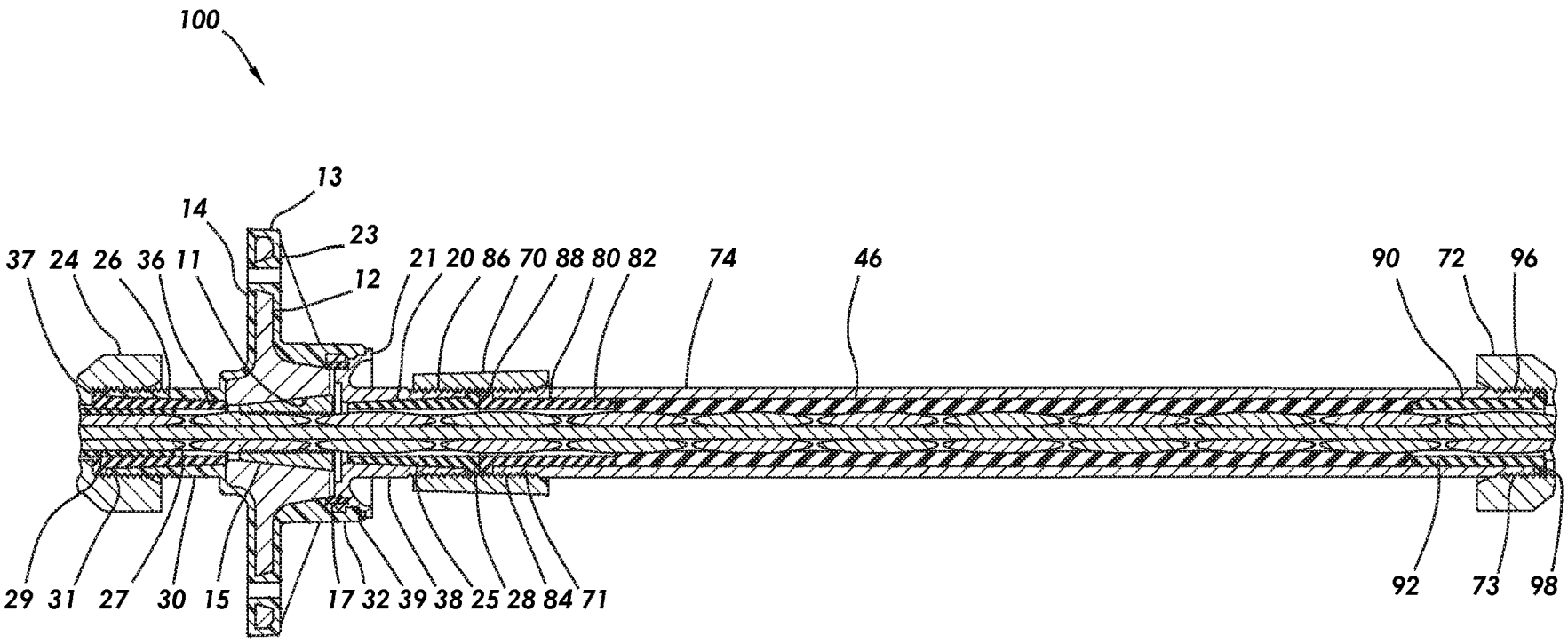
FIG. 2 is a cross-sectional view of an anchor and cover system consistent with at least one embodiment of the present disclosure.

Referring now to FIG. 2, in another embodiment, intermediate anchor and cover assembly 100 may include rear nut 24, anchor body 12, encapsulation 13, cap 21, coupler 70, cover 74, and remote nut 72. As illustrated, intermediate anchor and cover assembly 100 may be adapted to be received on tension member 27. Tension member 27 may include sheathing 29. A portion of sheathing 29 may be damaged or absent from the portion of the tension member 27 that passes through intermediate anchor and cover assembly 100. In certain embodiments, a single tension member 27 will extend among three anchors.

Anchor body 12 may be encapsulated in encapsulation 13. Anchor body 12 may have an anchor body bore extending therethrough and adapted to receive a tension member such as tension member 27. Anchor body 12 may include frustoconical inner surface 11 on which plurality of wedges 15 may seat when tensioning tension member 27 extending through anchor body 12.

Encapsulation 13 may have rear surface 14 and front surface 23. Rear surface 14 may include rear encapsulation extension 30 extending outwardly therefrom. Rear encapsulation extension 30 may include an inner bore coaxially aligned with the anchor body bore. Rear encapsulation extension 30 may be tubular. Rear encapsulation extension 30 may or may not be tapered and may or may not include external engagement feature 31, such as threads or bayonet tabs or a groove or ridge for securing a snap-fit. The inside diameter of rear encapsulation extension 30 may be greater than the outside diameter of tension member 27 or sheathing 29 so as to define an annular space therewith.

Rear seal 26 may sealingly engage rear encapsulation extension 30. Rear seal 26 may be a split seal having a longitudinal split that enables rear seal 26 to be applied to a tension member from the side, i.e. without requiring access to the tension member end. Rear seal 26 may be made of metal or of a soft elastomer, rubber, silicone, or other suitably deformable sealing material. Rear seal 26 may be sized to fit in the annular space between rear encapsulation extension 30 and tension member 27. In some embodiments, rear seal 26 may have rear seal body 36 and rear seal head 37. The outside diameter of rear seal body 36 may be the same as or smaller than the inside diameter of rear encapsulation extension 30 so that rear seal 26 may be applied to the side of tension member 27 and then slid along tension member 27 and into the annular space between rear encapsulation extension 30 and tension member 27.

Rear nut 24 may be provided to retain rear seal 26. Rear nut 24 may engage rear encapsulation extension 30 at external engagement feature 31, if present, and may include corresponding internal threads, bayonet tabs or a ridge or groove. In some embodiments, rear encapsulation extension 30 may be provided without an engagement feature and rear nut 24 may be a self-tapping nut that creates threads when it is threaded onto rear encapsulation extension 30. Rear seal 26 may be sized to have a volume greater than the volume of the annular space between rear encapsulation extension 30 and tension member 27 so that when rear nut 24 is fully engaged on rear encapsulation extension 30, rear seal 26 is compressed into a volume that is smaller than it would otherwise occupy. Rear seal head 37 may be compressed in an axial direction between rear nut 24 and rear encapsulation extension 30. Rear seal 26 may be formed of a deformable material that conforms to the shape of the annular space so that when rear nut 24 is fully engaged on rear encapsulation extension 30 there are no unfilled voids between anchor body 12 and rear nut 24.

Front surface 23 of encapsulation 13 may include front encapsulation extension 32 extending outwardly therefrom, Front encapsulation extension 32 may be annular and may include an inner bore coaxially aligned with the anchor body bore. Front encapsulation extension 32 may or may not include internal threads or bayonet tabs or a groove or ridge for securing a snap-fit.

Cap 21 may releasably engage front encapsulation extension 32 by, for example, friction fit, threads, or bayonet connection. Cap 21 may include engagement interface 39, cap extension 38, and inner bore that may align with the anchor body bore. Engagement interface 39 may releasably engage front encapsulation extension 32 at the internal threads or bayonet tabs or groove or ridge thereon, if present, and may include corresponding external threads, bayonet tabs or a ridge or groove.

Cap seal 17 may be disposed in an annular groove formed in cap 21 such that cap seal 17 sealingly engages at least one of anchor body 12 or encapsulation 13 when cap 21 is fully engaged on front encapsulation extension 32. Cap seal 17 may be annular or toroidal, and may be, for example, an O-ring.

Cap extension 38 may be tubular. The inner surface of cap extension 38 may be tapered and the outer surface of cap extension 38 may include external engagement feature 86, such as threads or bayonet tabs or a groove or ridge for securing a snap-fit. The inside diameter of cap extension 38 may be greater than the outside diameter of tension member 27 so as to define an annular space therewith.

Front seal 20 may sealingly engage cap extension 38. Front seal 20 may be a split seal having a longitudinal split that enables front seal 20 to be applied to a tension member 27 from the side, i.e. without requiring access to the tension member end. Front seal 20 may be made of metal or of a soft elastomer, rubber, silicone, or other suitably deformable sealing material. Front seal 20 may be sized to fit in the annular space between cap extension 38 and tension member 27. Front seal 20 may have body 25 and head 28. The outside diameter of body 25 may be the same as or smaller than the inside diameter of cap extension 38 so that front seal 20 may be applied to the side of tension member 27 and then slid along the tension member and into the annular space between cap extension 38 and tension member 27.

Coupler 70 may be configured to be rotated about tension member 27. Coupler 70 may mechanically couple to cap extension 38. Coupler 70 may retain front seal 20. Alternatively or in addition, coupler 70 may compress front seal 20. In some embodiments, coupler 70 may engage cap extension 38 at external engagement feature 86, if present, and may include corresponding internal threads, bayonet tabs or a ridge or groove. In some embodiments, cap extension 38 may be provided without an engagement feature and coupler 70 may be a self-tapping nut that creates threads as it is threaded onto cap extension 38.

In addition to engaging cap 21, coupler 70 may mechanically couple to cover 74. Cover 74 may be a split tube, i.e. able to be applied from the side of tension member 27. Cover 74 may fit around a tubular long seal 46, which may extend along a portion of the tension member. Cover 74 may be longer than tubular long seal 46, so that the ends of cover 74 extend beyond the ends of tubular long seal 46, leaving an annular space between each end portion of cover 74 and tension member 27. While cover 74 may be essentially symmetric, when applied as part of intermediate anchor and cover assembly 100, cover 74 will have proximal end portion 71 and remote end portion 73.

Proximal end portion 71 and remote end portion 73 may each include external engagement features 84, 96, respectively, such as threads, bayonet tabs, grooves, or ridges, to facilitate engagement with coupler 70 and remote nut 72, respectively. In some embodiments, one or both ends 51, 52 of outer tube 44 may be provided without an engagement feature and one or both of coupler 70 and remote nut 72 may include self-tapping threads.

In some embodiments, proximal end portion 71 of cover 74 may include external threads that are reverse threads relative to external threads on cap extension 38 so that rotation of coupler 70 in one direction about tension member 27 will draw cover 74 and cap extension 38 together and rotation of coupler 70 in the other direction about tension member 27 will push cover 74 and cap extension 38 apart.

A proximal seal 80 and a remote seal 90 may be positioned in the annular spaces between tension member 27 and proximal end portion 71 and remote end portion 73, respectively. Proximal seal 80 may include a head 88 and a body 82. Remote seal 90 may include head 98 and body 92.

In some embodiments, proximal seal 80 may sealingly engage proximal end portion 71 and remote seal 90 may sealingly engage remote end portion 73. Proximal seal 80 and remote seal 90 may each be a split seal having a longitudinal split that enables the seal to be applied to a tension member from the side, i.e. without requiring access to the tension member end. Proximal seal 80 and remote seal 90 may each be made of metal or of a soft elastomer, rubber, silicone, or other suitably deformable sealing material. The outside diameter of each proximal seal 80 and remote seal 90 may be the same as or smaller than the inside diameter of cover 74 so that each seal may be applied to the side of tension member 27 and then slid along the tension member and into the respective annular space between cover 74 and tension member 27.

Like rear seal 26, each seal, 20, 80, 90 (front, proximal, and remote) may be sized to have a volume greater than the volume of the annular space into which it fits so that assembly of intermediate anchor and cover assembly 100 causes each seal to be compressed into a volume that is smaller than it would otherwise occupy. Each seal 20, 80, 90 may be formed of a deformable material such that when intermediate anchor and cover assembly 100 is fully engaged as described below, there are no substantially unfilled voids between cap 21, coupler 70, proximal end portion 71 of cover 74 and tension member 27 or between remote end portion 73 of cover 74, remote nut 72, and tension member 27.

Head 28 of front seal 20 and head 88 of proximal seal 80 may both be compressed in an axial direction between the ends of cap extension 38 and tubular long seal 46. Head 98 of remote seal 90 may be compressed in an axial direction between remote nut 72 and remote end portion 73 of cover 74.

The components of the intermediate anchor and cover assembly 100 may be fully or partially pre-assembled prior to delivery to the pour site or may be assembled at the pour site.

Operation

In some embodiments, rear nut 24, anchor body 12 (including encapsulation 13, if present), cap 21, coupler 70, cover 74, and remote nut 72 may be applied to tension member 27 at an end of the tension member 27 and slid along the tension member to the desired location.

Some or all of the components of intermediate anchor and cover assembly 100 may be pre-assembled prior to delivery to the pour site or may be assembled at the pour site. For example, components of intermediate anchor and cover assembly 100 that are adapted to be mechanically coupled, such as rear nut 24 and rear encapsulation extension 30, may be provided in either a coupled or decoupled state. Seals 26, 20, 80, and 90 may be but are not necessarily included in the pre-assembly. If included, seals 26, 20, 80, and 90 may be removed before initiation of installation steps.

Because intermediate anchor and cover assembly 100 may be used at the interface between a first concrete pour and a second, adjacent concrete pour, portions of intermediate anchor and cover assembly 100 may be installed before the first pour and portions of intermediate anchor and cover assembly 100 may be installed between the first and second pours. Tension member 27 extends through both concrete pours. Anchor body 12 (including encapsulation 13, if present) may be embedded in the first pour and a front encapsulation extension 32 may be shielded by a pocket former (not shown), a removable cap such as cap 21, or the like so as to be exposed between the first and second pours, allowing for connection of cap 21 and the remainder of intermediate anchor and cover assembly 100.

In some embodiments, rear nut 24, anchor body 12 (including encapsulation 13, if present), and cap 21 may be positioned, such as at a concrete form that will contain the first pour. Anchor body 12 may be affixed to the concrete form with, for example, fasteners that may be placed through holes in encapsulation 13. If coupled to rear encapsulation extension 30, rear nut 24 may be decoupled therefrom. Rear seal 26 may be applied and slid along tension member 27 and into the space between rear encapsulation extension 30 and tension member 27. Rear nut 24 may then be recoupled to rear encapsulation extension 30, thereby compressing at least a portion of rear seal 26 and sealing the rear of the intermediate anchor.

The first concrete pour may then be made. Once the first concrete pour has cured sufficiently, the concrete form may be removed. Cap 21 may be decoupled from anchor body 12 or encapsulation 13 and slid along tension member 27 so as to allow access to the anchor body bore. More specifically, access to inner surface 11 is provided so that wedges 15 may be seated thereon prior to tensioning the tension member 27. Once wedges 15 are seated and tension member 27 has been tensioned, cap 21 may be recoupled to the anchor body 12 or encapsulation 13. The portion of tension member 27 extending outwardly from anchor body 12 through cap 21 may or may not be sheathed or, if sheathed, may include a section of damaged sheathing.

Figure 3:
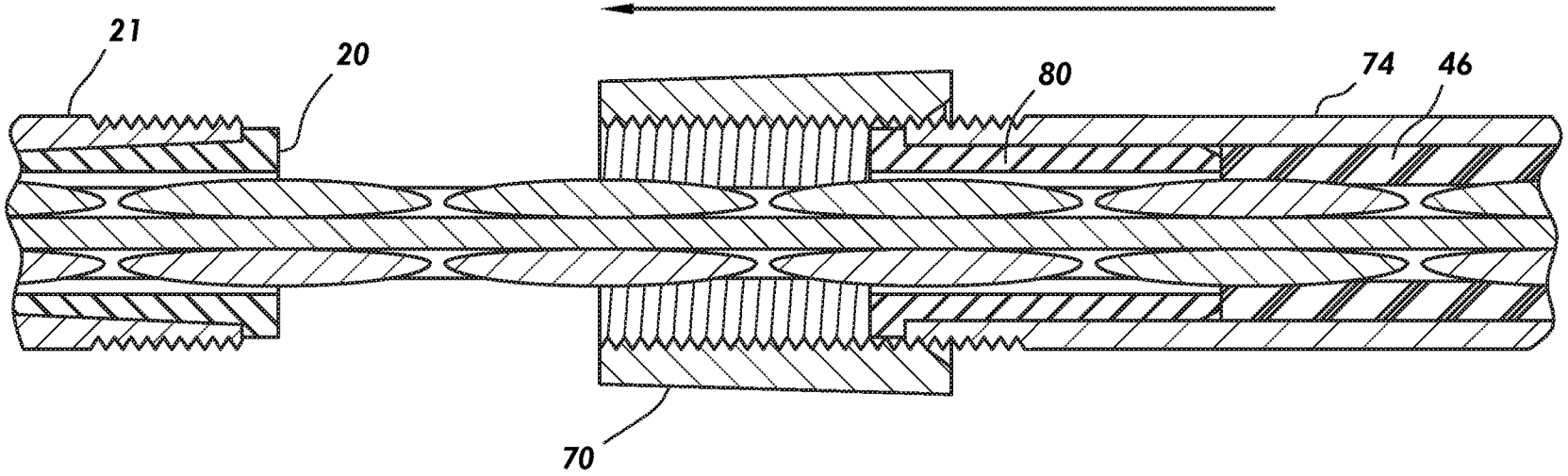
FIGS. 3 and 4 are enlarged cross-sections illustrating operation of the anchor and cover system of FIG. 2.
Figure 4:
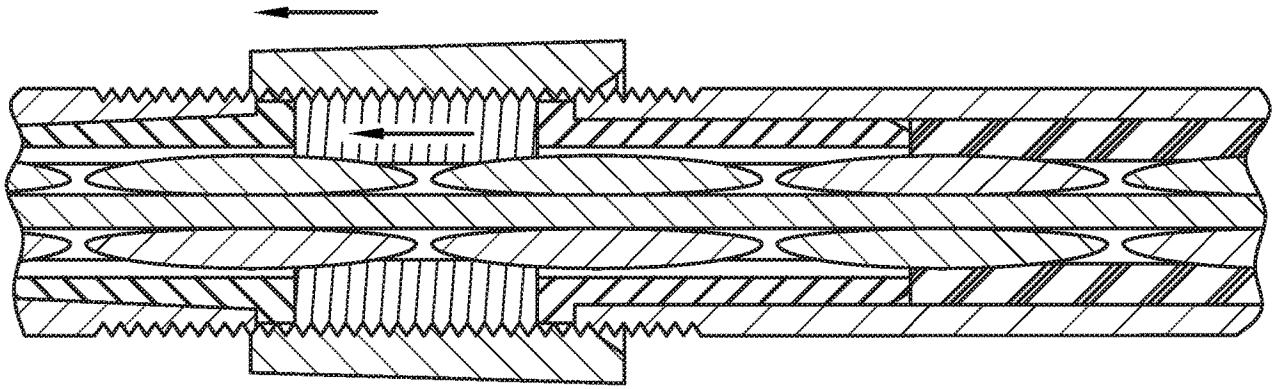

Referring now to FIGS. 3 and 4, with cap 21 recoupled to the anchor, front seal 20 may be slid into the space between cap 21 and tension member 27. At another point along tension member 27, proximal seal 80 may be slid into the space between cover 74 and tension member 27. Cover 74, proximal seal 80 and coupler 70 may be slid along tension member 27 as indicated by the arrow in FIG. 3 and positioned such that coupler 70 is between and adjacent to the end of cap extension 38 and the proximal end portion 71 of cover 74. The internal engagement mechanism of coupler 70 is positioned to engage the external engagement mechanisms of cap 21 and cover 74. In some embodiments, because proximal end portion 71 is reverse-threaded, rotation of coupler 70 may draw cover 74 toward cap 21, as indicated by the arrows in FIG. 4. Coupler 70 may be tightened to a desired torque or until seal heads 28, 88 are compressed to a desired degree, as illustrated in FIG. 2. Thus, coupler 70 may mechanically couple to cap extension 38 at a first threaded interface and mechanically couple to proximal end portion 71 at a second threaded interface, where the second threaded interface is reversed with respect to the first threaded interface.

Tubular long seal 46 may be applied with the aforementioned components or may be applied separately from the side of the tension member at a desired location or slid along the tension member to a desired location. In some embodiments, tubular long seal 46 may be long enough to fully cover and, optionally, extend beyond an unsheathed portion of tension member 27 or, if a portion of sheathing 29 has been removed, tubular long seal 46 may be positioned between the ends of the sheathing 29. With tubular long seal 46 in place between tension member 27 and cover 74, remote seal 90 may be inserted between tension member 27 and remote end portion 73 of cover 74 and remote nut 72 can be tightened into engagement with remote end portion 73 to a desired torque or so as to compress remote seal 90 to a desired degree.

An inner tube 56 may be applied to the outside of tubular long seal 46 after tubular long seal 46 is applied to the tension member 27 and before or after tubular long seal 46 is positioned at the unsheathed portion thereof. Inner tube 56 may already be present on tension member 27 or may be applied from the end of tension member 27.

With rear nut 24, coupler 70 and remote nut 72 each, intermediate anchor and cover assembly 100 may be considered fully assembled. In some embodiments, in the fully assembled state, intermediate anchor and cover assembly 100 may include no internal voids. In some embodiments, in the fully assembled state, intermediate anchor and cover assembly 100 may provide a fluid-tight seal along the entire portion of tension member 27 that is enclosed therein.

When assembled, intermediate anchor and cover assembly 100 defines a longitudinal passage that is adapted to receive a tension member and to sealingly engage the outer surface thereof. The presence of the intermediate anchor and cover assembly 100 on tension member 27 seals the portion of the tension member that is within the assembly, i.e. between each adjacent pair of seals. Thus, portions of tension member 27 for which sheathing 29 may be damaged or lacking, along with anchor body 12 and wedges 15, can be sealed against fluid intrusion. In each embodiment and each method described herein, repairing a tension member may include re-sheathing the portion of the tension member that is within intermediate anchor and cover assembly 100 to prevent the ingress of fluid into the tension member 27.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Further, in the claims that follow, unless explicitly so recited, the sequential recitation of steps is not intended to require that the steps be performed sequentially.

What is claimed is:

1. An assembly for use with a tension member for post-tensioning concrete, comprising:

an anchor body;

an encapsulation, wherein the encapsulation at least partially encapsulates the anchor body and wherein the encapsulation includes a rear encapsulation extension and a front encapsulation extension;

a rear nut mechanically coupled to the rear encapsulation extension;

a cap mechanically coupled to the front encapsulation extension, the cap including a cap extension;

a cover extending around a portion of the tension member, the cover having a proximal end portion and a remote end portion;

a coupler mechanically coupled to both the cap extension and the proximal end portion; and a remote nut mechanically coupled to the remote end portion.

2. The assembly of claim 1, further including:

a rear seal positioned between the rear encapsulation extension and the tension member;

a front seal positioned between the cap extension and the tension member;

a proximal seal positioned between the proximal end portion and the tension member; and a remote seal positioned between the remote end portion and the tension member.

3. The assembly of claim 2 wherein the rear, front, proximal, and remote seals are each a split seal.

4. The assembly of claim 2 wherein the rear, front, proximal, and remote seals are sized such that tightening the rear nut, coupler, and remote nut deforms the rear, front, proximal, and remote seals.

5. The assembly of claim 1, further including a rear seal positioned between the rear extension and the tension member, wherein the rear seal includes a head compressed in an axial direction between the rear nut and rear encapsulation extension.

6. The assembly of claim 1, further including a front seal positioned between the cap extension and the tension member, a proximal seal positioned between the proximal end portion and the tension member, and a tubular long seal positioned between the tension member and the cover, wherein the front seal and the proximal seal each include a head compressed in an axial direction between the cap extension and the tubular long seal.

7. The assembly of claim 6, further including an inner tube positioned between the long seal and the cover.

8. The assembly of claim 1, further including a remote seal positioned between the remote end portion and the tension member, wherein the remote seal includes a head compressed in an axial direction between the remote nut and the remote end portion of the cover.

9. The assembly of claim 1 wherein the coupler mechanically couples to the cap extension at a first threaded interface and mechanically couples to the proximal end portion at a second threaded interface and wherein the second threaded interface is reversed with respect to the first threaded interface.

10. The assembly of claim 1, further including a cap seal disposed in an annular groove formed in the cap, wherein the cap seal engages at least one of the anchor body or the encapsulation.

11. The assembly of claim 1, wherein the assembly is adapted for use when the tension member extends among three anchors.

12. A method, comprising the steps of:

a) positioning an assembly on a portion of a tension member, the assembly comprising:

an intermediate anchor, the intermediate anchor comprising:

an anchor body; and an encapsulation, wherein the encapsulation at least partially encapsulates the anchor body and wherein the encapsulation includes a rear encapsulation extension and a front encapsulation extension;

a rear nut;

a cap, wherein the cap includes a cap extension;

a cover, wherein the cover is tubular and has a proximal end portion and a remote end portion;

a coupler; and a remote nut;

b) mechanically coupling the cap to the front encapsulation extension;

c) positioning a rear seal between the rear encapsulation extension and the tension member and mechanically coupling the rear nut to the rear encapsulation extension;

d) positioning a front seal between the cap extension and the tension member;

e) positioning a tubular long seal on the tension member;

f) positioning the cover around the tubular long seal;

g) positioning a proximal seal between the proximal end portion and the tension member;

h) mechanically coupling the coupler to the cap extension and the proximal end portion; and i) positioning a remote seal between the remote end portion and the tension member and mechanically coupling the remote nut to the remote end portion.

13. The method of claim 12 wherein at least two of the components are mechanically coupled during step a).

14. The method of claim 12 wherein none of the components are mechanically coupled during step a).

15. The method of claim 12 wherein the rear seal includes a head and wherein step c) compresses the rear seal head in the axial direction between the rear nut and rear encapsulation extension, wherein the front seal and the proximal seal each include a head and wherein step i) compresses the front seal head and the proximal seal head in the axial direction between the cap extension and the tubular long seal, and wherein the remote seal includes a head and wherein step h) compresses the remote seal head in the axial direction between the remote nut and the remote end portion of the cover.

16. The method of claim 12 wherein step e) includes positioning the tubular long seal so as to span an unsheathed portion of the tension member.

17. The method of claim 12 wherein the assembly defines a longitudinal passage that is adapted to receive a tension member and to sealingly engage the outer surface thereof, further including the step of sheathing the portion of the tension member.

18. The method of claim 12 wherein the coupler mechanically couples to the cap extension at a first threaded interface and mechanically couples to the proximal end portion at a second threaded interface, wherein the second threaded interface is reversed with respect to the first threaded interface, and wherein step h) comprises rotating the coupler about the tension member.

19. The method of claim 12 wherein the cap includes a cap seal disposed in an annular groove formed in the cap and wherein step b) causes the cap seal to sealingly engage at least one of the anchor body or the encapsulation.

20. The method of claim 12, further including the step of positioning an inner tube between the tubular long seal and the cover before step f).

21. The method of claim 12, further including the step of removing the inner tube from between the tubular long seal and the outer tube before step i).

22. The method of claim 12, wherein the tension member extends among three anchors.

23. A kit for assembling an assembly for use with a tension member for post-tensioning concrete, comprising:

an anchor body;

an encapsulation, the encapsulation at least partially encapsulating the anchor body and including a rear encapsulation extension and a front encapsulation extension;

a rear nut adapted to mechanically couple to the rear encapsulation extension;

a cap adapted to mechanically couple to the front encapsulation extension, the cap including a cap extension;

a cover adapted to extend around a portion of the tension member, the cover being tubular and having a proximal end portion and a remote end portion;

a coupler adapted to mechanically couple to both the cap extension and the proximal end portion; and a remote nut adapted to mechanically couple to the remote end portion.

24. The kit of claim 23, further including:

a rear seal adapted to fit between the rear encapsulation extension and the tension member;

a front seal adapted to fit between the cap extension and the tension member;

a proximal seal adapted to fit between the proximal end portion and the tension member; and a remote seal adapted to fit between the remote end portion and the tension member.

25. The kit of claim 23 wherein the rear, front, proximal, and remote seals are each a split seal.

26. The kit of claim 23 wherein the rear, front, proximal, and remote seals are each sized such that tightening the rear nut, coupler and remote nut to a desired degree deforms the rear, front, proximal, and remote seals such that there are substantially no internal voids in the assembly.

27. The kit of claim 23, further including a rear seal adapted to fit between the rear extension and the tension member, wherein the rear seal includes a head adapted to be compressed in an axial direction between the rear nut and rear encapsulation extension.

28. The kit of claim 23, further including a front seal adapted to fit between the cap extension and the tension member, a proximal seal adapted to fit between the proximal end portion and the tension member, and a tubular long seal adapted to fit between the tension member and the cover, wherein the front seal and the proximal seal each include a head adapted to be compressed in an axial direction between the cap extension and the tubular long seal.

29. The kit of claim 23, further including a remote seal adapted to fit between the remote end portion and the tension member, wherein the rear seal includes a head adapted to be compressed in an axial direction between the remote nut and the remote end portion of the cover.

30. The kit of claim 23 wherein the coupler mechanically couples to the cap extension at a first threaded interface and mechanically couples to the proximal end portion at a second threaded interface and wherein the second threaded interface is reversed with respect to the first threaded interface, whereby rotation of the coupler in a direction draws the cover and the cap extension together.

* * * * *